US006269929B1

(12) United States Patent
McClellan

(10) Patent No.: US 6,269,929 B1
(45) Date of Patent: Aug. 7, 2001

(54) COIN GUARD AND TELEPHONE FACE PLATE

(76) Inventor: W. Thomas McClellan, 2571 Del Largo Dr., Fort Lauderdale, FL (US) 33316

( * ) Notice: Subject to any disclaimer, the term of this patent is extended or adjusted under 35 U.S.C. 154(b) by 0 days.

(21) Appl. No.: 09/176,559

(22) Filed: Oct. 21, 1998

(51) Int. Cl.[7] ..... G07F 1/02
(52) U.S. Cl. ..... 194/344
(58) Field of Search ..... 194/344, 347, 194/348, 349

(56) References Cited

U.S. PATENT DOCUMENTS

| | | | | |
|---|---|---|---|---|
| D. 389,521 | | 1/1998 | McClellan | D20/9 |
| 683,280 | * | 9/1901 | Hofheimer | 194/344 X |
| 1,111,764 | * | 9/1914 | Rolland | 194/344 X |
| 1,903,048 | * | 3/1933 | Jennings et al. | 194/344 |
| 1,996,143 | * | 4/1935 | Callison | 194/344 X |
| 2,144,545 | * | 1/1939 | Peters | 194/344 |
| 5,524,143 | | 6/1996 | Turk et al. | 379/350 |

* cited by examiner

*Primary Examiner*—F. J. Bartuska
(74) *Attorney, Agent, or Firm*—Herbert L. Lerner; Laurence A. Greenber; Werner H. Stemer

(57) ABSTRACT

A coin guard to be installed in front of a coin slot of a coin evaluating mechanism of a coin operated vending machine. The coin guard providing a coin entrance separate from the coin slot in order to protect the coin evaluating mechanism from theft and vandalism. In addition, there is a telephone face plate with an integrated coin guard.

13 Claims, 6 Drawing Sheets

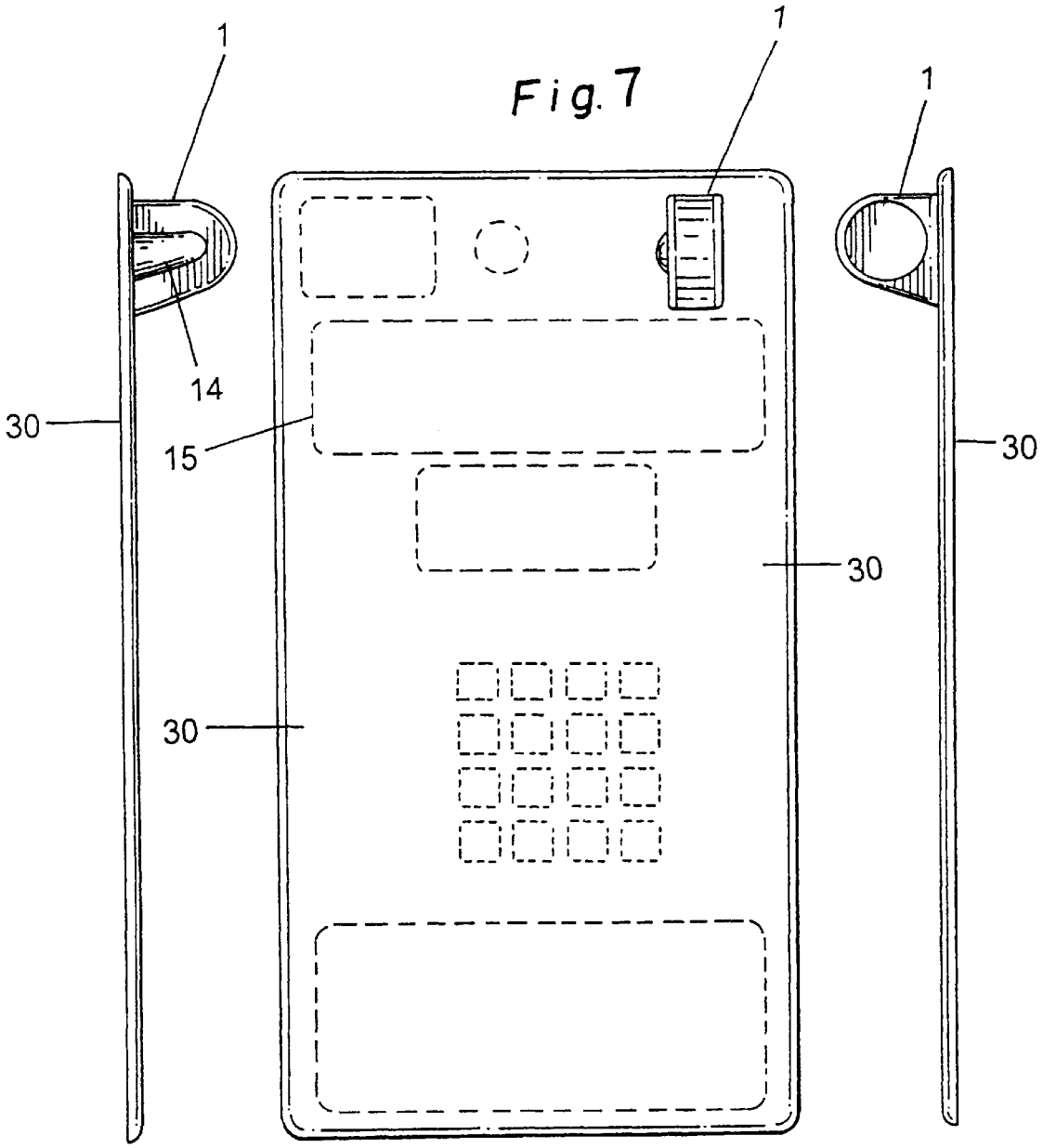
Fig. 7
Fig. 8
Fig. 9
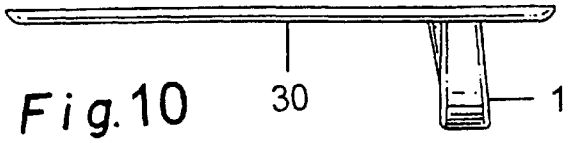
Fig. 10

Fig.13
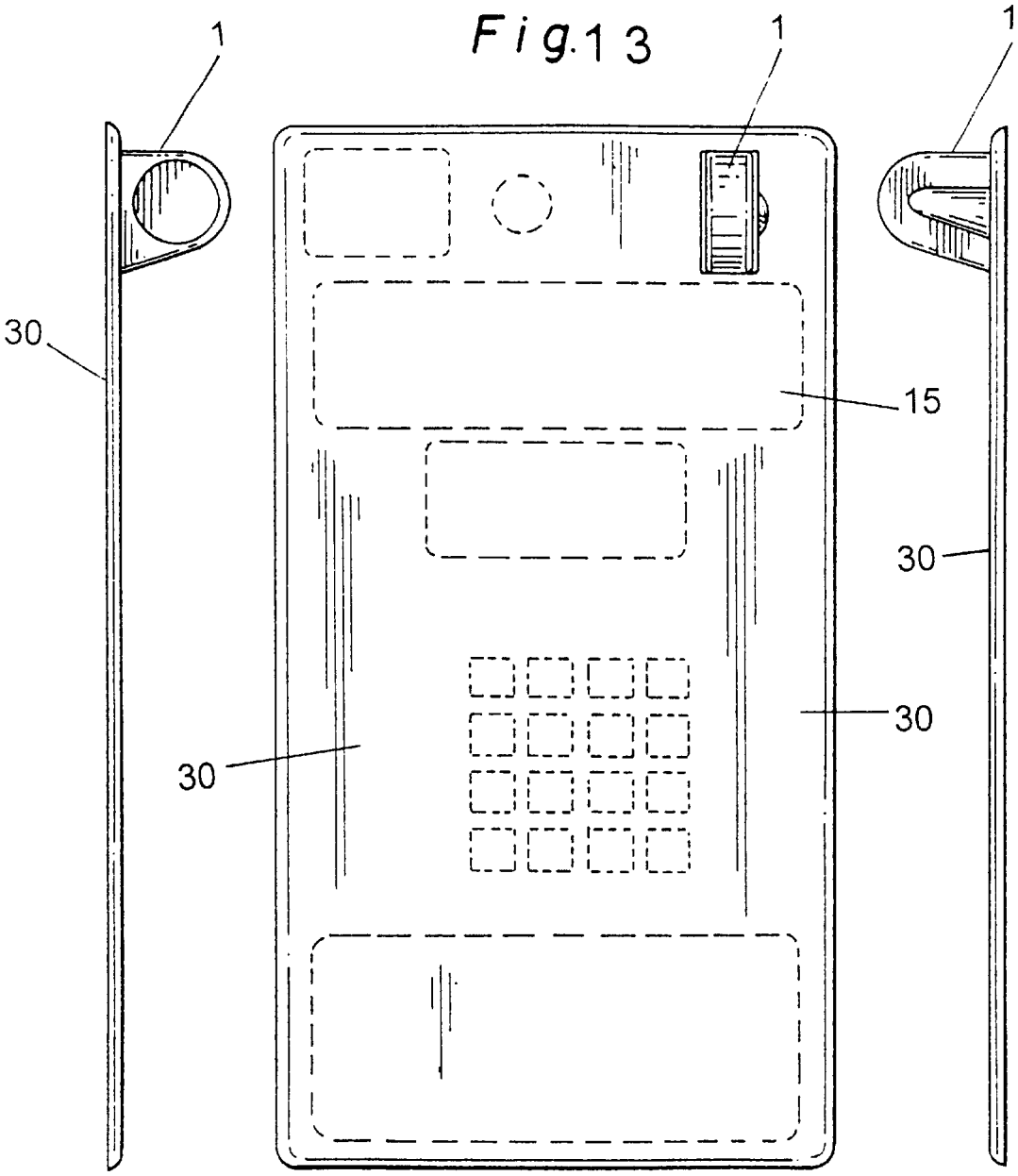
Fig.14
Fig.15
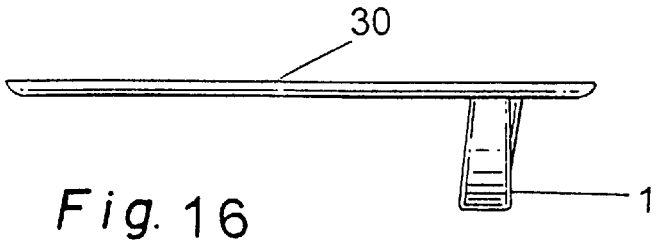
Fig. 16

COIN GUARD AND TELEPHONE FACE PLATE

BACKGROUND OF THE INVENTION

1. Field of the Invention

The invention relates, generally, to coin operated machines such as telephones, vending machines, parking meters, laundry machines and other types of coin operated devices, more specifically, it relates to an improved coin receiving and delivery device.

2. Description of the Related Art

Coin operated devices such as telephones and vending machines generally have a face plate containing an entrance or coin slot for receiving a coin. The face plate has a coin chute or channel behind the coin slot for allowing passage of the coins into the coin mechanism. The coin mechanism evaluates the entered coins and causes the coin operated device to operate as desired.

The coin chute must be open and clear enough to allow free and reliable passage of the deposited coins into the coin mechanism. This open, semi-straight coin path provides a reliable and easy to use face plate, however, it has also become an easy, open target susceptible to criminal activity.

Various methods are used to illegally remove coins from coin operated devices such as parking meters. The more popular theft techniques involve: a. the placement of stuffing material deep inside the coin passage for the collection of coins to be later picked out (retrieved) or pushed into the coin return chute, b. the placement of wire type devices into the coin slot to damage the coin mechanism and force coin removal; and c. the injection of glue and glue-like substances into the coin slot to store deposited coins for later removal.

SUMMARY OF THE INVENTION

It is accordingly an object of the invention to provide a coin guard and telephone face plate, which overcomes the herein-mentioned disadvantages of the heretofore-known devices of this general type, which provides greater protection to the coin mechanism.

The unique configuration of the coin guard assists in preventing criminal activity and vandalism. First, the coin guard helps prevent the insertion of stuffing material deep inside the coin chute by making access to the chute of the coin mechanism more difficult than the prior art devices. Second, it makes the insertion of a wire-like device into the coin operated device more difficult as one now must overcome the indirect coin chute formed by the coin guard. Only discontinuous, round, coin-like objects having a maximum diameter of about 1 3/32inches and a maximum thickness of about 3/32 inches can negate the offset or indirect path of the coin chute in the coin guard. Continuous objects like wires, coat hangers or blades are prohibited by the combination of the lateral translation of the coin entrance and the forward translation needed to navigate the coin chute. In other words, only round, flat, limited diametered objects can freely travel within the coin guard. Third, the coin guard obstructs the injection of glue-like substances into the coin mechanism and thus prevents damage, malfunction or fraud of the coin mechanism. Fourth, the coin guard acts as a visual deterrent to those contemplating illegal activity relating to the coin operated device. Fifth, the coin guard reduces vandalism to the coin operated device as the internal mechanisms are harder to access. Sixth, the coin guard controls the insertion rate of coins into the coin mechanism by regulating the speed of coin insertion and thus prevents rapid coin insertion jamming techniques. Seventh, the coin guard acts as a visual positive advertisement to the user that this machine is protected and is more likely to be in proper working order than an unprotected coin operated machine.

The coin guard can be retrofitted into existing machines as the coin guard can be manufactured to be compatible with any face plate configuration.

With the foregoing and other objects in view there is provided, in accordance with the invention, a coin guard, including: a back plate; a body connected to the back plate, the body having a coin entry and a coin channel formed therein, the coin entry communicating with the coin channel; and the body having a first width in a region closest to the back plate and a second width in a region furthest from the back plate, the second width greater than the first width.

In accordance with an added feature of the invention, the coin entry is circular in shape.

In accordance with an additional feature of the invention, the coin entry has a depth of at least 5/8 inches.

In accordance with another feature of the invention, the body extends out substantially perpendicular from the back plate.

In accordance with a further added feature of the invention, there is a reinforcement disposed on the body for strengthening the body.

In accordance with a further additional feature of the invention, the body has a right-side face and a left-side face and the coin entry is disposed on either the right-side face or the left-side face.

In accordance with yet another feature of the invention, the coin guard components are manufactured from materials selected from the group consisting of aluminum, other metals, metal alloys, composites and plastics.

In accordance with yet another added feature of the invention, the coin channel has a length of at least 3/8 inches.

In accordance with yet another additional feature of the invention, the first width is at least 9/16 of an inch and the second width is at least 3/4 of an inch.

In accordance with an added feature of the invention, the body has a rounded front face.

In accordance with an additional feature of the invention, the back plate has at least one hole formed therein.

With the foregoing and other objects in view there is provided, in accordance with the invention, in combination with a telephone having a coin evaluating mechanism and a front surface, a face plate including: a face plate body dimensioned to fit over the front surface of the telephone; and a coin guard having a coin entry and a coin channel with a coin slot formed therein disposed on the face plate body and communicating with the coin evaluating mechanism.

The invention is a specially configured security device to prevent one from tampering with the coin operated device. More specifically, the coin guard is configured to prevent the insertion of a wire and similar continuous objects into the coin operated devices for committing fraud and/or damaging the coin operated devices having coin mechanisms. In this regard, the length of the coin travel path or coin channel has been increased, the depth of the coin entry has been increased, and the coin entry is formed in a tapered body resulting in an overhang over the coin entry. The combination of features is effective in preventing criminal wire action known as "wire rotation advancement". First, the tapered body worsens the effective angle in which a wire must be inserted in order to access the coin mechanism.

Second, the depth of the coin entry further increases the angle in which a wire-like device must be entered and the length of the travel path the wire must undergo in order to reach the coin mechanism. Third, the increased length of the coin channel further hampers the ability of inserting the wire through the coin guard and into the coin mechanism. In this manner, a straight wire is prevented from entry and a wire bent at various locations and rotationally advanced must overcome the various impediments presented by the coin guard.

Furthermore, a triangular reinforcement web is positioned on the wall of the coin path for preventing the distortion or widening of the coin channel to allow better access to the coin operated mechanism. The triangular reinforcement web is configured to withstand hammer blows and the like for opening up the coin guard to allow advancement to the coin mechanism.

No previous prior art device is believed to teach this level of protection to a coin operated device as provided by the unique features of the coin guard. Each mentioned feature has by itself a unique function (i.e. providing a greater angle, length, and/or strength) for preventing fraud or damage to the coin mechanism. In summary, the coin guard provides superior theft protection than what is believed to be known in the prior art.

Other characteristic features of the invention are set forth in the appended claims.

Although the invention is illustrated and described herein as embodied in a coin guard and telephone face plate, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

BRIEF DESCRIPTION OF THE DRAWINGS

FIG. 7 is a front elevational view of a telephone face plate integrated with the coin guard having a coin entry on the right-side face.

FIG. 8 is a left-side elevational view of the telephone face plate;

FIG. 9 is a right-side elevation view of the telephone face plate;

FIG. 10 is a top plan view of the telephone face plate;

FIG. 13 is a front elevational view of a second embodiment of the telephone face plate integrated with the coin guard having a coin entry on the left-side face;

FIG. 14 is a left-side elevational view of the second embodiment of the telephone face plate;

FIG. 15 is a right-side elevation view of second embodiment of the telephone face plate; and FIG. 16 is a top plan view of the second embodiment of the telephone face plate.

DESCRIPTION OF THE PREFERRED EMBODIMENTS

Figure 1:
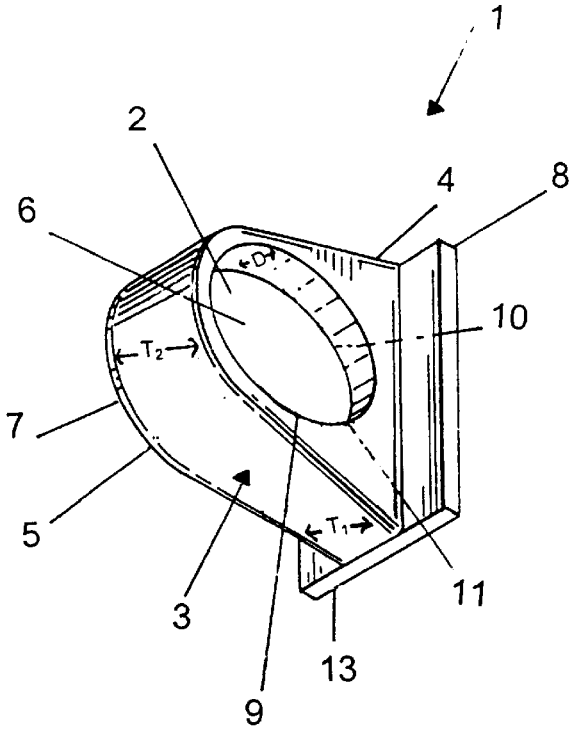
FIG. 1 is a diagrammatic, perspective view of a coin guard with a coin entry on a right-side face according to the invention.

Referring now to the figures of the drawings in detail and first, particularly, to FIG. 1 thereof, there is shown a coin guard 1 for protecting a coin mechanism of a coin operated machine. The coin mechanism generally has a slot for receiving money and as mentioned earlier, the coin slot is an easy theft target. The coin guard 1 is configured to be placed over or in front of the coin slot for isolating a coin entry point from the actual coin mechanism. The coin guard 1 has a coin entry 2 with a substantially circular shape and is disposed on the right-side of the coin guard 1. The coin entry 2 is shown as having a circular shape but could have other shapes including but not limited to octagonal and hexagonal shapes. The coin entry 2 may be of any size but is preferable within the range of 1–1¾ inches in diameter and is ideally 1³⁄₁₆ inches in diameter. This limits the size of a coin that may be entered into the coin entry 2, but more importantly, it prevents the entry of devices (i.e. wires, knifes) and materials that may be entered towards the coin slot of the coin mechanism.

Figure 3:
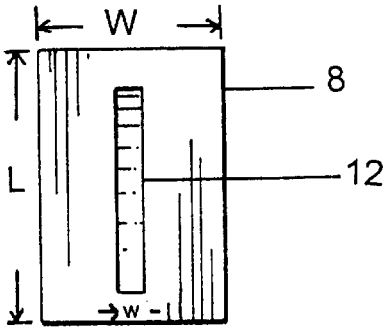
FIG. 3 is a rear elevational view of the coin guard.

The coin entry 2 is formed in a body 3 having a right face 4 and a left face 5. An inside surface 6 of the left face 5 forms a coin stop 9 that is the back of the coin entry 2. The body 3 is shown to have a rounded front face 7 and angles downward toward a bottom 13 of a back plate 8. The inside surface 6 of the left face 5 and an inside surface 10 of the right face 4 define a coin channel 11 in which a coin travels down to a slot opening 12 (FIG. 3). The slot opening 12 of the coin guard 1 is in direct alignment with the slot opening of the coin mechanism when the coin guard 1 is retrofitted on or integrated with the coin mechanism. The width W' of the slot opening 12 and the coin channel 11 is arbitrary but generally has a range of ⅛ to ⁵⁄₁₆ inches and is preferably ³⁄₁₆ inches. It is further noted that the shape of the body 3 is arbitrary so long as the body 3 can be configured to have the coin entry 2 and the coin channel 11 formed therein.

The coin channel 11 has an angled travel path angled down towards the bottom 13 of the back plate 8. The angle of the coin travel path is defined by both horizontal and vertical components in the coin channel 11 and is in the range of 2–75 degrees as seen from the coin entry 2 to the back plate 8. A length L' of the coin channel 11 can be arbitrarily set and a reasonable range is between ¼–1 inch and is preferably about ⅜ inches. The longer the length L', the harder it is to get to the coin slot of the coin mechanism, and therefore the greater protection to the coin mechanism.

The back plate 8 is generally rectangular in shape but could easily be of any shape. The back plate 8 is dimensioned so that it can be easily retrofitted into existing coin mechanisms. The back plate 8 generally has a width W (FIG. 3) in the range of 1–3 inches and is preferably about 1¹³⁄₁₆ inches. The back plate 8 has a length L in the range of 1–3 inches and is preferably 1½ inches. It is noted that the length L and the width w can be of any size that is limited only by the ability to be match with a respective coin mechanism. The back plate 8 may also be formed with holes 16 on each side to assist in retrofitting the coin guard onto an existing coin mechanism. The back plate 8 has an arbitrary thickness T3 (FIG. 2) that is generally in the range of 1/16 to 3/8 inches and is preferably about 1/8 inches thick. Optionally, the top surface and the edges of the back plate 8 may be rounded.

The body 3 generally extends out substantially perpendicular from the back plate 8. It is noted that the body 3 could extend out at a reasonable angle from the back plate 8 and in general in a range of 20–160 degrees. Furthermore, the body 3 is tapered. In the region of the back plate 8, the body 3 has a taper width T1 that is arbitrary but has a general range of 1/8–4 inches and is preferably 9/16 inches. In the region of the rounded front face 7, the body has a taper width T2 that is arbitrary but has a general range of 1/4–4 1/2 inches and is preferably about 3/4 inches. The tapered shape of the body 3 provides an overhang for the coin entry 2 from the front face 7 to the back plate 8. The tapered overhang increases the difficulty of inserting devices and materials into the coin channel 11.

The depth D of the coin entry 2 is also very important. The depth D is in the range of 1/8 to 4 inches and is preferably about 5/8 of an inch. The deeper the depth D, the harder it is to angle a device or material into the coin channel 11 of the coin guard 1. On the other hand, the deeper the depth the harder it is to place a coin into the coin channel 11.

Figure 2:
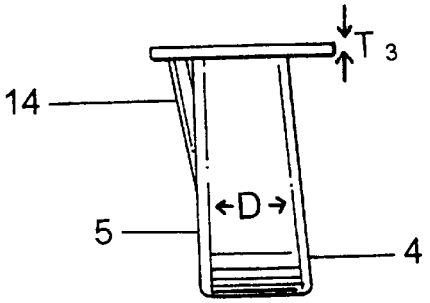
FIG. 2 is a top plan view of the coin guard.
Figure 4:
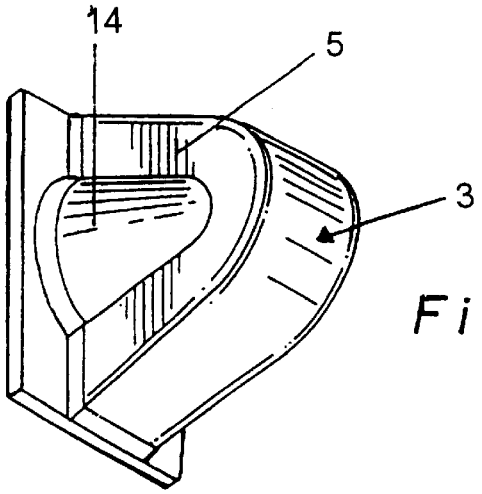
FIG. 4 is a left-side, perspective view of the coin guard.

In FIGS. 2 and 4 the left face 5 of the body 3 is shown with a reinforcement 14. The reinforcement 14 adds structural strength to the coin guard 1 and helps prevents breakage of the coin guard 1 when it is struck (i.e. a hammer blow). The reinforcement 14 extends substantially across the left face 5 and has a thickness in the range 1/16 to 5/8 inch and is preferably 3/16 of an inch. It is noted that the reinforcement 14 can be configured in any shape and any thickness.

Figure 5:
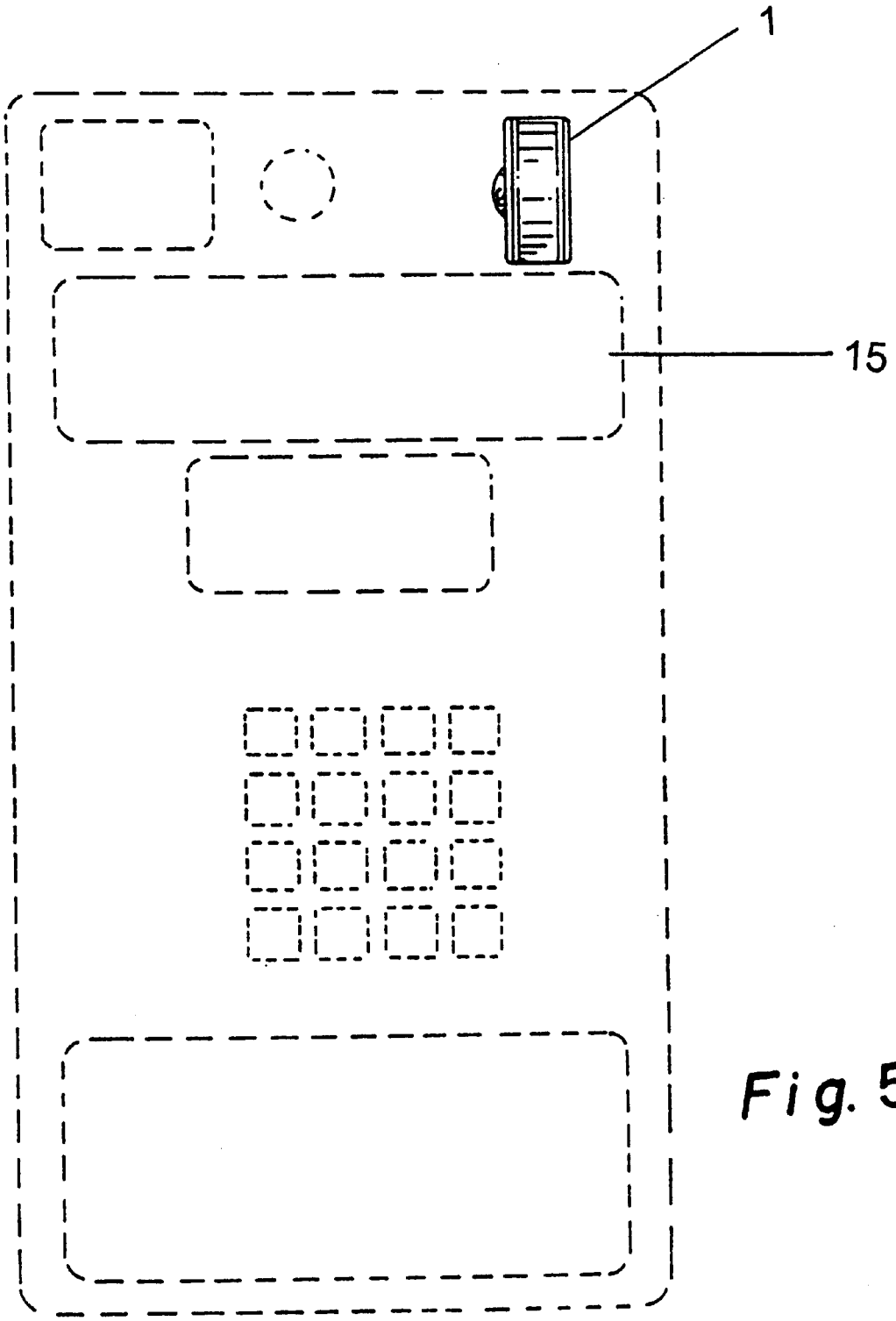
FIG. 5 is a front elevational view of the coin guard installed on a telephone shown in dashed lines.

FIG. 5 shows the coin guard 1 installed on a telephone 15.

Figure 6:
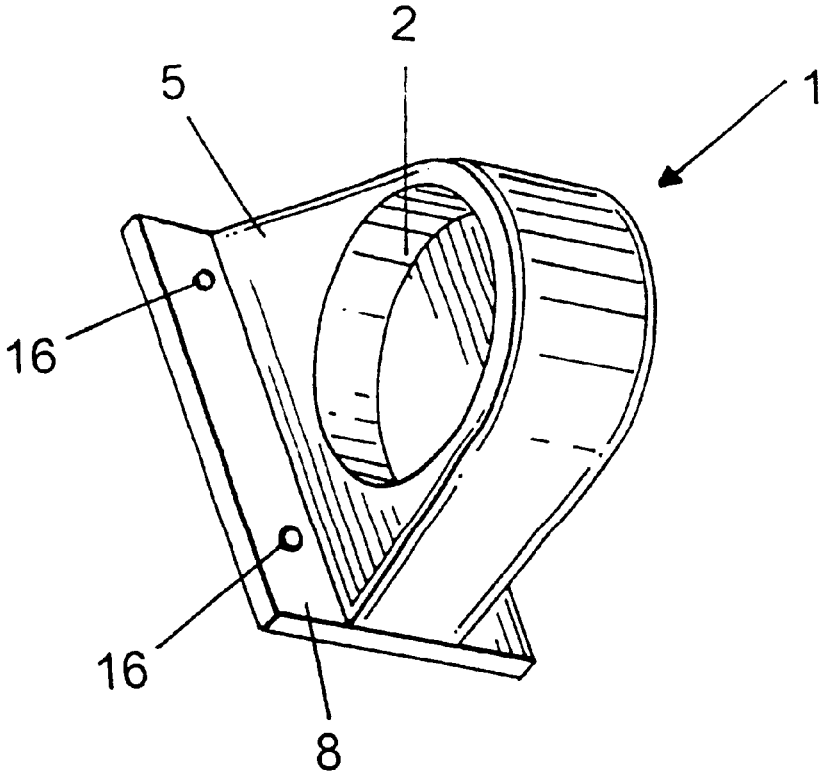
FIG. 6 is a perspective view of a second embodiment of the coin guard having a coin entry on a left-side face.
Figure 11:
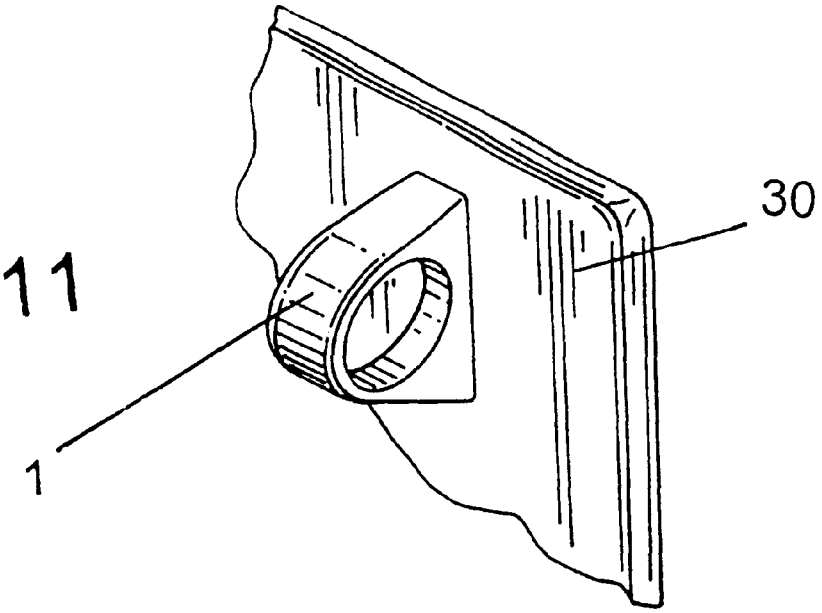
FIG. 11 is a partial, perspective view of the telephone face plate showing a detailed view of the coin guard.

FIG. 6 shows a second embodiment of the coin guard 1. The coin entry 2 in the second embodiment is formed on the left-side in the left face 5 instead of on the right-side. All other features are similar to those shown in FIGS. 1–4 for the coin guard 1 having a coin entry 2 on the right-side.

The coin guard 1 can be manufactured from various materials including aluminum, other metals, metal alloys, composites and plastics.

The coin guard can be configured for various coin operated devices including but not limited to vending machines, pay phones, parking meters, laundry machines, and amusement games.

Figure 12:
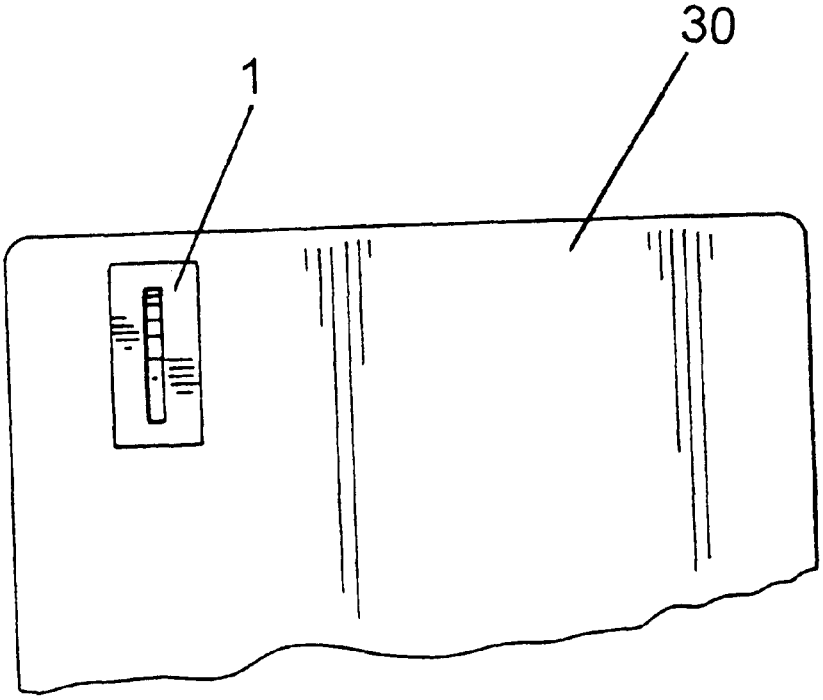
FIG. 12 is a partial, rear elevational view of the telephone face plate.

FIGS. 7–12 show the coin guard 1 with a coin entry on the right-side face integrated with a telephone face plate 30 to be fitted on the telephone 15. The telephone face plate 30 can be retrofitted onto existing telephones 15 by swapping out an old face plate with the telephone face plate 30 of the instant application. FIG. 12 shows the coin slot 12 of the coin guard that is to be aligned directly in front of the coin evaluating device of the telephone 15. The dimensions of the telephone face plate 30 is wholly dependent on the shape of the telephone 15 and is constructed of suitable materials similar to that of the coin guard 1 mentioned previously.

FIGS. 13–16 show the telephone face plate 30 with the integrated coin guard 1 having a coin entry on the left-side face.

I claim:

1. A coin guard, comprising a back plate;

a body connected to said back plate, said body having a coin entry and a coin channel formed therein, said coin entry communicating with said coin channel; and said body having a tapered shape widening from a first width in a region proximal to said back plate to a second width in a region distal from said back plate.

2. The coin guard according to claim 1, wherein said coin entry is circular in shape.

3. The coin guard according to claim 1, wherein said coin entry has a depth of at least 5/8 inches.

4. The coin guard according to claim 1, wherein said body extends out substantially perpendicular from said back plate.

5. The coin guard according to claim 1, including a reinforcement disposed on said body for strengthening said body.

6. The coin guard according to claim 1, wherein said body has a right-side face and said coin entry is disposed on said right-side face.

7. The coin guard according to claim 1, wherein said body has a left-side face and said coin entry is disposed on said left-side face.

8. The coin guard according to claim 1, wherein said coin guard components are manufactured from materials selected from the group consisting of aluminum, other metals, metal alloys, composites and plastics.

9. The coin guard according to claim 1, wherein said coin channel has a length of at least 3/8 inches.

10. The coin guard according to claim 1, wherein said first width is at least 9/16 of an inch and said second width is at least 3/4 of an inch.

11. The coin guard according to claim 1, wherein said body has a rounded front face.

12. The coin guard according to claim 1, wherein said back plate has at least one hole formed therein.

13. A coin guard, comprising:

a back plate;

a body connected to said back plate, said body having a coin entry with a depth of at least 5/8 inches and a coin channel formed therein, said coin entry communicating with said coin channel;

said body having a tapered shape widening from a first width in a region proximal to said back plate to a second width in a region distal from said back plate; and a reinforcement disposed on said body for strengthening said body.

* * * * *